United States Patent [19]

Holmstrom et al.

[11] 4,122,225

[45] Oct. 24, 1978

[54] METHOD AND APPARATUS FOR COATING TILE

[75] Inventors: Ernest R. Holmstrom; Merrill M. Smith, both of Morrisville, Pa.; Donald C. Ferguson, Trenton, N.J.

[73] Assignee: American Biltrite, Inc., Cambridge, Mass.

[21] Appl. No.: 694,692

[22] Filed: Jun. 10, 1976

[51] Int. Cl.[2] ..... B05D 3/06; B05D 1/36; B05D 5/00

[52] U.S. Cl. ..... 428/172; 118/641; 427/54; 427/264; 427/265; 427/44; 427/266; 427/269; 427/271; 427/278; 427/287

[58] Field of Search ..... 427/264, 265, 266, 269, 427/271, 278, 287, 44, 54, 261; 428/172, 173; 118/206, 641

[56] References Cited

U.S. PATENT DOCUMENTS

| | | | |
|---|---|---|---|
| 2,160,560 | 5/1939 | Parkinson | 427/266 |
| 2,855,327 | 10/1958 | Gilchrist et al. | 427/265 X |
| 3,749,592 | 7/1973 | Gaske et al. | 427/54 X |

*Primary Examiner*—Michael R. Lusignan
*Attorney, Agent, or Firm*—Pennie & Edmonds

[57] ABSTRACT

A tile having pre-formed edges and an exposed decorative relief surface with high areas subject to greater than average wear and low areas subject to less than average wear is provided with a protective coating which is thicker on the high areas than on the low areas. The coating covers the exposed surface without covering the pre-formed edges. Such coatings are provided in high volume production apparatus by the steps of (a) providing a continuous succession of base tiles with abutting front and back edges; (b) spraying a first coating of protective material onto the exposed surface of the tile from one or more points vertically within the side edges; (c) at least partially curing the first coating; (d) applying a second coating of protective material primarily onto the high areas on the exposed surface by roller coating; and (e) curing the protective coating. In preferred embodiments, the protective coating material is cured by exposing it to ultraviolet radiation.

28 Claims, 9 Drawing Figures

METHOD AND APPARATUS FOR COATING TILE

BACKGROUND OF THE INVENTION

The desirability of providing tiles with a shiny, durable, "no wax" protective coating has long been recognized. The problem has been to develop a process for coating tiles in high volume quickly and economically. This seemingly simple problem is complicated by several factors including the high cost of suitable protective materials, the presence on tile of decorative relief surfaces having high areas and low areas subject to different levels of wear, and the undesirability of applying protective materials onto the tile edges.

The straightforward approach of first coating large sheets with protective materials and then cutting tiles from the sheets is unduly wasteful of highly expensive coating material. Typically tiles are cut from wide sheets of flooring material such as vinyl or vinyl asbestos by what is known as the "in-line" or "picture-frame" process. In such cutting, a border of sheet material (resembling a picture frame) is left around each tile for permitting removal of the tile from the cutting die. While the material of the border can be recycled for its vinyl or vinyl asbestos content, any protective materials thereon are lost. Also lost are any protective materials applied to reject tiles. In view of the facts that protective coating materials can cost 18 to 25 dollars per gallon and millions of tiles are made each year, the resultant waste is substantial.

The coating of the tiles after cutting is complicated by the fact that one must coat the entire exposed surface, and yet avoid coating the edges. Coated edges are highly objectionable because they would prevent adjacent tiles from merging together when they are laid on surface such as a floor. Yet there is no readily apparent way to mask the edges compatible with high volume production.

In addition, the popularity of tiles with decorative relief surfaces has rendered many conventional coating techniques inappropriate. Such relief surfaces have high areas which, particularly in vinyl asbestos tile, are subject to greater than average wear and low areas which are subject to less than average wear. While all areas of the surface need some coating to maintain a uniform shiny appearance, a uniform thickness coating or a coating which is thicker in the low areas would be wasteful of the coating material.

SUMMARY OF THE INVENTION

In accordance with the invention, a tile having preformed edges and an exposed decorative relief surface with high areas subject to greater than average wear and low areas subject to less than average wear is provided with a protective coating which is thicker on the high areas than on the low areas. The coating covers the exposed surface without covering the pre-formed edges. Such coatings are provided in high volume production apparatus by the steps of (a) providing a continuous succession of base tiles with abutting front and back edges; (b) spraying a first coating of protective material onto the exposed surface of the tile from one or more points vertically within the side edges; (c) at least partially curing the first coating; (d) applying a second coating of protective material primarily onto the high areas on the exposed surface by roller coating; and (e) curing the protective coating. In preferred embodiments, the protective coating material is cured by exposing it to ultraviolet radiation.

BRIEF DESCRIPTION OF THE DRAWINGS

The advantages, nature, and various additional features of the invention will appear more fully upon consideration of the illustrative embodiments now to be described in detail in connection with the accompanying drawings in which.

Similar reference characters indicate corresponding parts throughout the several views of the drawings, and the dimensions of the parts as shown in the drawings are exaggerated in order to more clearly illustrate the principles of the invention.

DETAILED DESCRIPTION

A. The Abuttment of Front And Back Edges

Figure 1A:
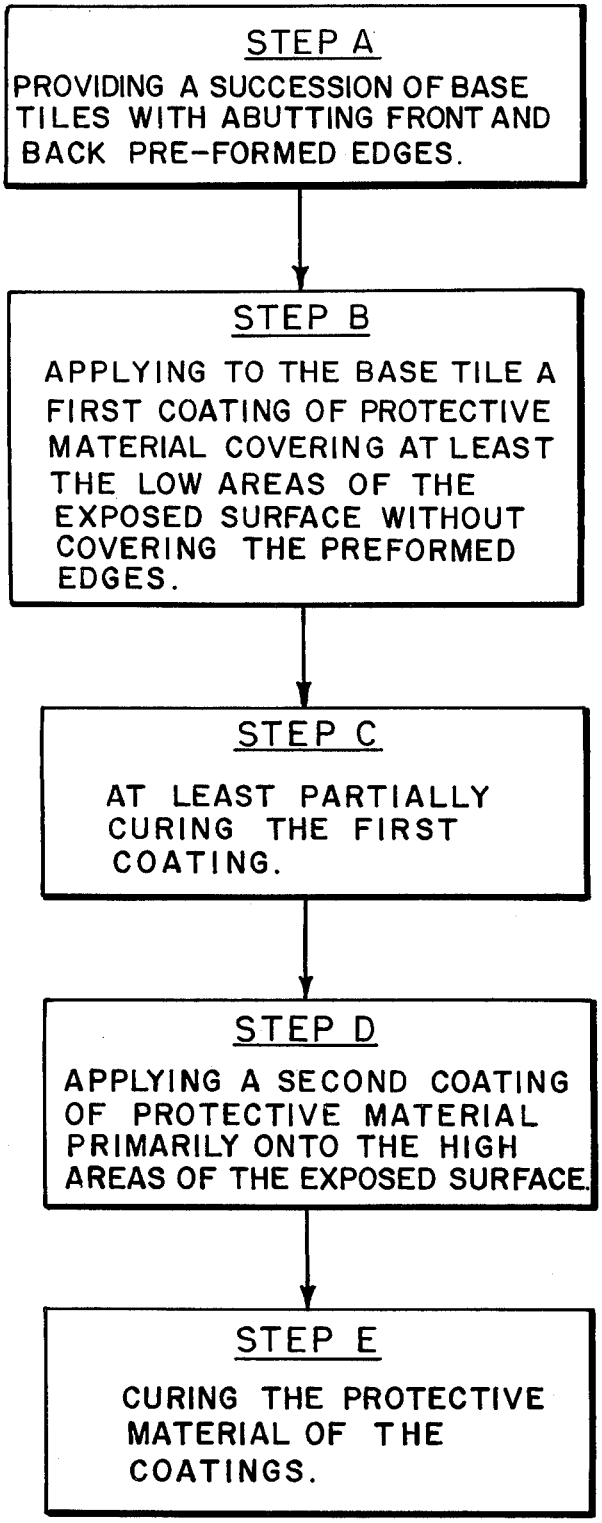
FIG. 1A is a flow diagram of the steps of the method of providing tile with a protective coating in accordance with the invention.

Referring to the drawings, FIG. 1A is a flow diagram illustrating a preferred method of applying a protective coating to tile in accordance with the invention. As illustrated, the initial step involves providing a succession of base tiles with abutting front and back preformed edges. Typically the base tiles are uncoated vinyl or vinyl asbestos tiles which have been pre-cut from wide sheets using any conventional process such as the above described picture-frame process. While the method of the invention can be used to coat flat planar surfaces exposed to wear, it is most advantageous when used to coat exposed decorative relief surfaces.

Figure 1B:
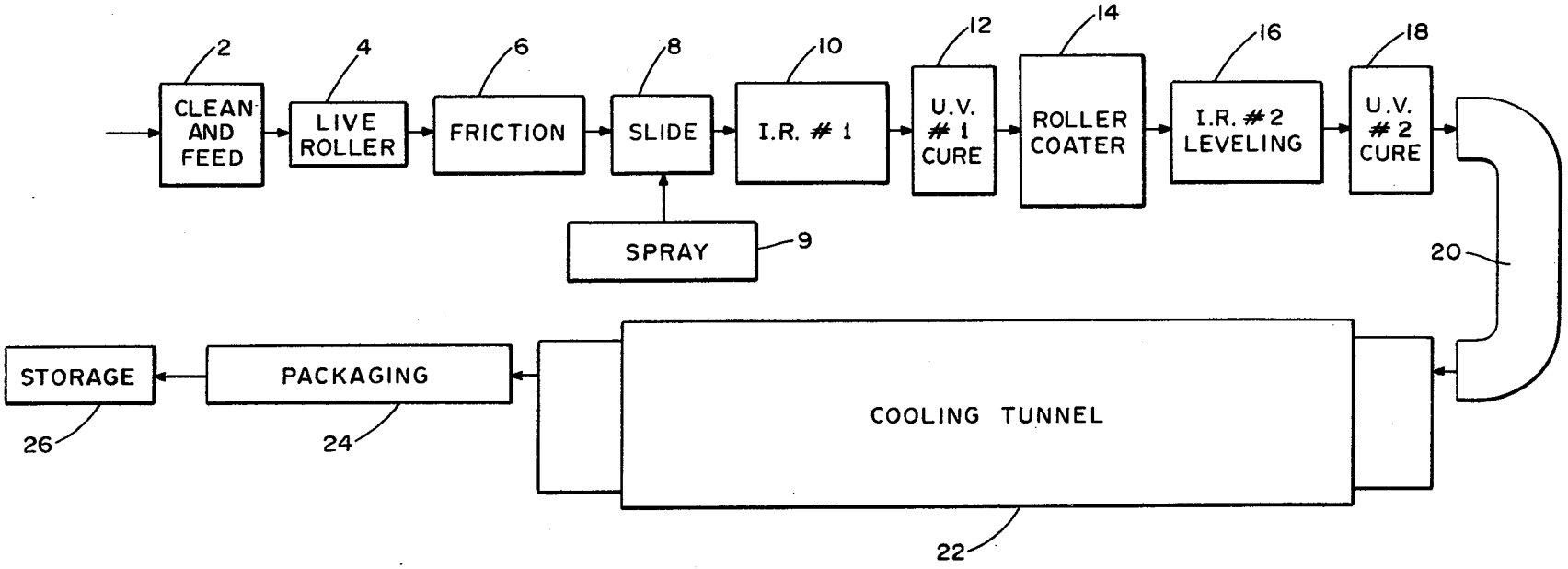
FIG. 1B is a diagram schematically illustrating preferred apparatus for providing tile with a protective coating in accordance with the invention.

The base tiles can be provided to the coating process in the form of a succession of tiles with abutting front and back edges by the apparatus schematically illustrated in FIG. 1B. Typically the pre-cut base tiles arrive in stacks. The stacks are fed into a conventional feeder 2 which, by a shuttle or slide mechanism, successively deals the base tiles one at a time under a cleaning brush onto a live roller conveying mechanism 4 and thence to a friction-type conveyor belt 6. The friction-type conveyor belt, in turn, transports the individual base tiles to a retarding mechanism such as a slide 8. At the slide, which may be a plate or plurality of rails, each tile is sufficiently slowed down by friction that the front edge of the next successive tile abuts against its back edge. Similarly, the front edge of the tile abuts against the back edge of the preceding successive tile.

B. The Initial Coating

The next step shown in FIG. 1A is the application of a first coating of protective material covering at least the low areas of the exposed surface without covering the pre-formed edges. Preferably this initial coating is applied by spraying the protective material onto the exposed surface. In order to prevent objectionable coating of the front and back edges, the spray is applied while the front and back edges of successive tiles abut one another, and in order to prevent coating of the side edges, the spray is directed onto the surface from one or more points vertically within the side edges so that the edges always remain within the shadow of the exposed surface.

The viscosity of the initial coating material is preferably chosen to permit a thin, substantially uniform thickness coverage of the entire surface and, for spray coating, typically lies in the range of 1 to 4 poise. The initial coating can be relatively thin because it need only protect the low areas of the exposed surface subject to little wear. Typically it will have a substantially uniform thickness in the range between 0.3 and 0.6 mil.

The ultraviolet curable coating materials can comprise mixtures of one or more resins, a monomeric carrier and, if necessary, a photo-initiator. Suitable resins include acryloester, acryloether, acrylolactone and acrylourethane. These resins can be formed by reacting respective polymers of polyester, polyether, polylactone or polyurethane with acrylate or methacrylate containing a functional hydroxyl group. Suitable monomeric carriers include monomers of acrylate and methacrylate. Suitable photoinitiators include benzoin ether materials and a variety of commercially available proprietary products such as Vicure 10 marketed by the Stauffer Chemical Company, New York, New York.

Especially preferred for spray coating of vinyl or vinyl asbestos is a coating mixture predominantly comprised of acrylourethane resin and 10 to 60% of an acrylate or methacrylate monomeric carrier. Such a coating mixture is commercially available from the Hughson Chemical Company, Erie, Pa., under the product designation RD 2840-2.

It is noteworthy that the above-described coating materials are not solutions, but rather are radiation curable fluid solids. Solvents are not generally useful in the coating of vinyl asbestos materials because most solvents of useful protective coating materials will harm the surface of the tiles.

As an optional part of this initial coating process, the freshly coated tiles can be passed under a conventional infrared heating device (element 10 of FIG. 1B) in order to produce a smoother more uniform coating surface. The heater should warm the tiles and coating sufficiently that the coating will flow level, but the temperature should not exceed the temperature at which the tile will deform. Preferably the surface of the tile is heated to a temperature within the range of 90° to 110° Fahrenheit.

C. The Spray Coating Apparatus

Figure 5:
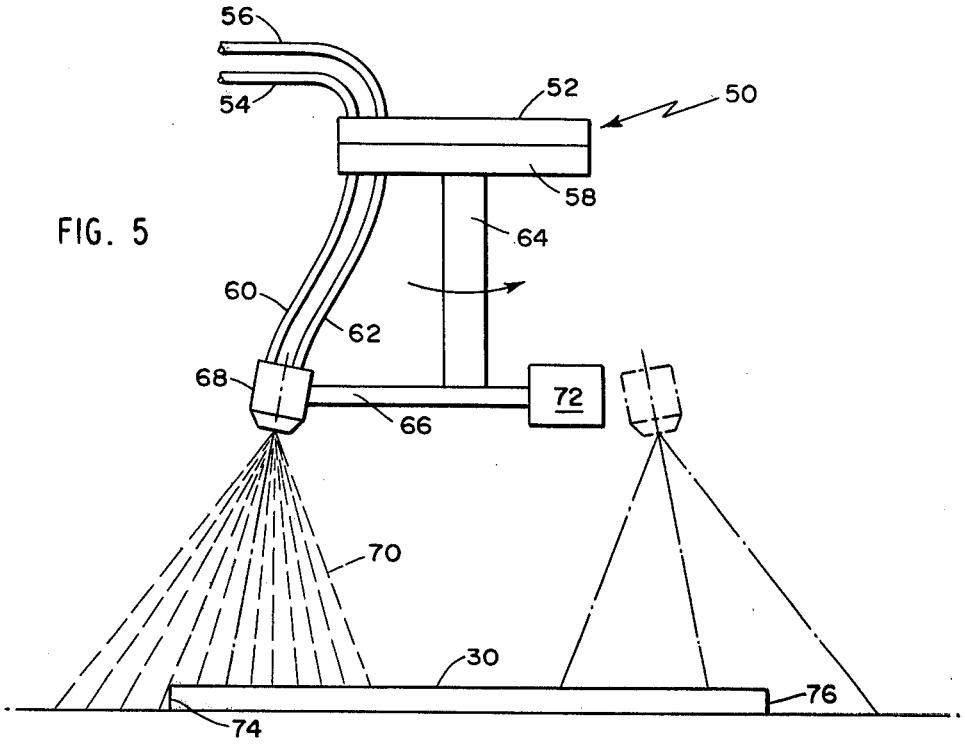
FIG. 5 is a schematic illustration of a preferred spray coating apparatus for providing the first coating of protective material in accordance with the invention.

The initial coating is preferably applied by the spray coating apparatus designated element 9 of FIG. 1B and illustrated in greater detail in FIGS. 5, 6, 7, and 8. FIG. 5 illustrates a preferred spray coater comprising a rotating, continuous flow, distribution valve 50 having a stationary member 52 and a rotating member 58 rotatably fastened and sealed with respect thereto. Member 58 is rotated by suitable means (not shown).

A conventional spray head 68 is coupled to rotatable member 58 by an arm 66 attached to a shaft 64. The spray head is centrifugally counter-balanced on shaft 64 by means of a suitable weight 72. Thus mounted, with rotation of member 58, the spray head rotates in a circular orbit. A single counter-balanced spray head is preferred over a double head because failures of a single head are much more readily detected visually than failures of but one of two heads.

Compressed air and coating material are continuously supplied from supply tubes 54 and 56, respectively, to delivery tubes 60 and 62, respectively, through suitably matching respective grooves (not shown) in the engaging faces of members 52 and 58. Thus, the spray head is continuously supplied despite its orbital rotation.

After the coating material reaches spray head 68, it is forcefully sprayed from a central orifice (not shown) along the dotted spray lines 70 onto the exposed surface of tile 30. By choosing a radial length for arm 66 which is less than about half the width of tile 30, one can assure that spray head 68 will not pass outside a vertical projection of the side edges 74 and 76 of tile 30, thus insuring that these edges will always be shadowed from spray lines 70 by the exposed surface.

Figure 8:
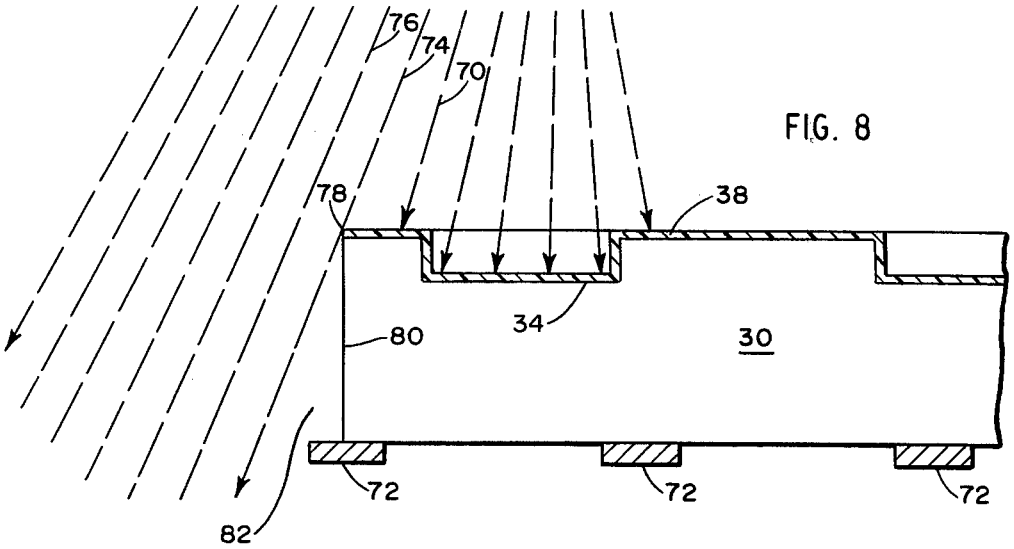
FIG. 8 is an enlarged sectional view, partly schematic, illustrating the spraying of the first coating of protective material onto the portion of the tile near the pre-formed side edges.

FIG. 8 illustrates the shadowing of the side edges in greater detail. The figure shows an enlarged portion of a tile 30 having a decorative relief surface comprising low areas 34 and high or "land" areas 38. The tile is shown moving under the spray coating apparatus on a slide comprising a pluraliity of rails 72. The spray of coating material from the spray head (not shown) travels along straight lines depicted by dashed lines 70, 74, and 76.

It is readily observed that the edge portion 78 of the exposed surface casts a shadow from the spray in the region indicated by the numeral 82 and including side edge 82. Thus, the side edges are kept relatively clean from deposition of the coating material. The protective effect of this shadowing can be enhanced by tilting the spray head so that any spray directed toward the edge region of the exposed surface arrives at a small acute angle rather than at an angle approaching 90°.

Figure 6:
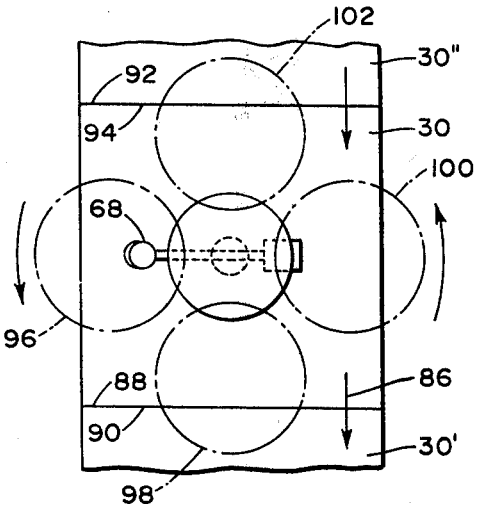
FIGS. 6 and 7 are schematic plan views, useful in explaining the practice of the invention, showing the spray apparatus of FIG. 5, and a plurality of tiles with abutting front and back pre-formed edges.
Figure 7:
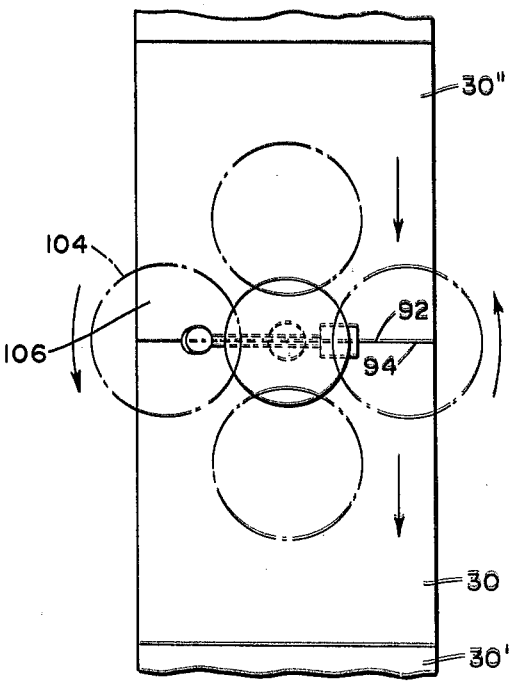

FIGS. 6 and 7 further illustrate the operation of the spraying apparatus on a succession of abutted tiles. FIG. 6 depicts a succession of a tile 30, a preceding tile 30' and a succeeding tile 30'' moving in the direction of arrow 86 under orbitally rotating spray head 68. The front edge 88 of tile 30 abuts the rear edge 90 of tile 30', and the front edge 92 of tile 30'' abuts the rear edge 94 of tile 30. Thus, these edges are 30'' abuts the rear edge 94 of tile 30. Thus, these edges are protected from the spray.

By rotating spray head 68 at sufficient speed, one can readily spray the entire exposed surfaces of the moving tiles. This fact may be seen by visualizing the dot-dash lines 96, 98, 100, and 102 as the circles of deposition of spray material at four phantom instantaneous positions of the spray head. FIG. 7 illustrates the circles of deposition at a later time when the tiles have moved further forward. Provided the spray head is rotated completely around before the tile moves forward by a distance approximately equal to the diameter of a circle of deposition, the exposed surface will be completely covered.

In a preferred arrangement, the spray head is mounted about 10 inches above the tile and rotates in a 10-inch diameter orbit within the side edges of a 12-inch tile. With a nozzle pressure of about 70 pounds per square inch, it projects a 6-inch wide circular band of deposition. Spray head speeds of about 480 revolutions per minute are used to coat approximately 120 tiles per minute.

D. Initial Cure

The next step illustrated in FIG. 1A involves at least partially curing the first coating of protective material. This curing is effected with the preferred coating materials by exposing them to ultraviolet light. Preferably, the tiles after emerging from the infrared heating apparatus are passed into a chamber 12 of FIG. 1B where they are exposed to a conventional ultraviolet light source such as that marketed by Radiation Polymer Co., Van Dyke Road, Plainfield, Ill.

E. The Second Coating

The next step involves applying a second coating of protective material onto primarily the high areas of the exposed surface. This step is preferably effected by roller coating a material of the type described in connection with the initial coating but at a viscosity in the range of 2 to 25 poise and at a thickness in the range of 1.5 to 3.5 mils. Such coating will cover the high areas of the decorative relief surface with only a negligible flow down to the low areas. An especially preferred coating composition for roll-coating vinyl asbestos tile is a coating mixture predominantly comprised of acryloure-thane and 5 to 35% of an acrylate or methacrylate monomeric carrier, such a coating mixture is commercially available as a product marketed by Hughson Chemical Company, Erie, Pa. under under the product designation RD2797-4.

FIG. 1B illustrates preferred apparatus for applying the second coat. From partial curing apparatus 12, a conventional conveyor belt carries the tiles to a conventional roller coating apparatus 14. The preferred roller-coating apparatus is a plural-roll type such as that marketed by Black Brothers, 501 Meitz Avenue, Mendote, Ill. The apparatus has two pairs of rollers. The first roller in each pair has a helical land which meters and spreads the coating material on the second roller. The second roller of each pair which typically has a larger diameter, smooth cylindrical surface is pressed into engagement with the high portions of the tiles. Coating material from the second rollers is laid primarily onto the high portions of the tiles as they pass underneath the second rollers of each pair.

Although a single pair of rollers can be used, two pairs are preferred with the tiles passing successively beneath each pair. In the first pair, the metering roller can preferably have a 45 per inch trihelical distribution of lands, and in the second pair, the metering roller can have a 45 per inch or 110 per inch distribution.

Again, as an optional part of the coating process, the freshly applied layer can be leveled on the high areas by warming the exposed surface and coating material in an infrared apparatus 16 of FIG. 1B.

F. The Final Cure

The next step in the process is completely curing the protective material. Preferably, the material is cured by exposing it to ultraviolet radiation in a second ultraviolet radiation curing stage 18 of FIG. 1A similar to stage 12 but having additional radiation lamps in order to cure the thicker combined coatings.

After the final cure, the tiles are advantageously cooled before storage. Accordingly, high volume production apparatus is advantageously provided with a conventional cooling tunnel 22 wherein the tiles can be cooled by air blasts or refrigeration apparatus to cool the tile to near ambient temperatures. In the preferred apparatus of FIG. 1B, the tiles are moved from the curing apparatus 18 to the cooling tunnel 22 by a turn-around conveyor belt 20. From the cooling tunnel 22, the tiles are passed to a packaging apparatus 24, and thence to a suitable storage area 26.

G. The Resulting Tile

Figure 2:
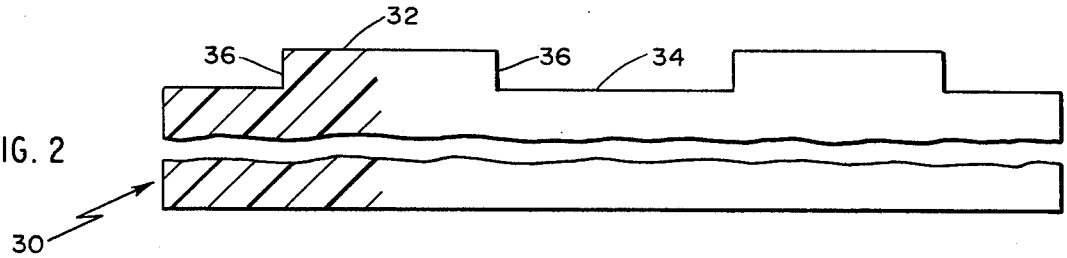
FIG. 2 is a sectional elevation showing a base tile having an exposed relief surface to be provided with a protective coating in accordance with the invention.
Figure 3:
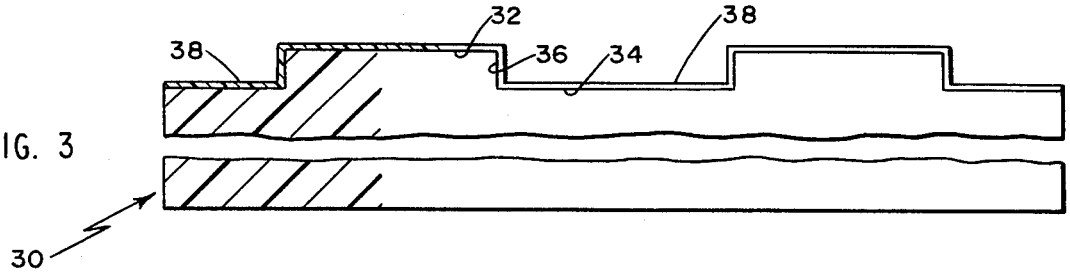
FIG. 3 shows the base tile of FIG. 2 after the first coating of protective material has been applied to the relief surface.
Figure 4:
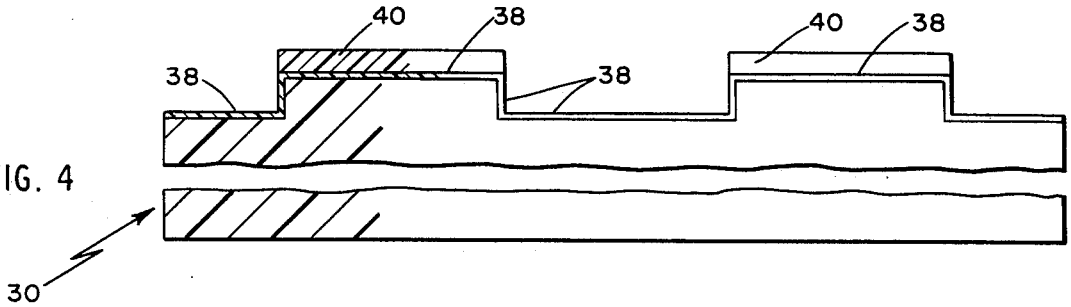
FIG. 4 shows the tile of FIGS. 2 and 3 after the second coating of protective material has been applied primarily to the high areas of the relief surface.

FIGS. 2, 3, and 4 illustrate various stages in the manufacture of a coated tile in accordance with the invention. FIG. 2 shows a cross section of a typical uncoated base tile 30 having a decorative relief surface comprising a decorative pattern of high areas 32, low areas 34, and walls 36. Tile having such decorative surfaces can be made in accordance with techniques well-known in the art such as embossing.

FIG. 3 shows a cross section of the same base tile after the first coating step. A thin coating 38 of protective material covers at least the low areas of the exposed relief surface and preferably the entire surface (other than the edges) in a thin layer of substantially uniform thickness. The preferred coating viscosities, thicknesses, and compositions have been specified in connection with the initial coating step.

FIG. 4 shows a cross section of the initially coated tile of FIG. 3 after the second relatively thicker coating of protective material 40 has been applied primarily to the high areas of the exposed decorative relief surface and after the final cure. Thus, finished product is provided with a composite protective coating wherein the high areas subject to greatest wear are provided with the greatest thickness protective material. The preferred coating viscosities, thicknesses, and compositions have been specified in connection with the second coating step.

While the invention has been described in connection with the coating of vinyl and vinyl asbestos tiles, it is clear that it is equally applicable to tiles of other composition materials and even wood parquet tiles. Similarly, the preferred ranges of thicknesses for the respective first and second coatings are those found preferable for customary usage. The invention can equally well be used to apply thicker or thinner coatings in the manufacture of tile for special applications.

While the invention has been described in connection with a small number of specific embodiments, it is to be understood that these embodiments are merely illustrative of the many possible specific embodiments which can represent applications of the principles of the invention. Numerous and varied methods, apparatus, and products can be devised by those skilled in the art without departing from the spirit and scope of the present invention.

We claim:

1. A method for coating tile having an exposed decorative surface subject to wear including high areas subject to greater than average wear and low areas subject to less than average wear comprising the steps of:

providing a plurality of base tiles, each tile having pre-formed front, back, and side edges, in a continuous succession with the front and back edges of adjacent tiles abutting one another;

while said front and back edges are abutting, spraying a first coating of protective material onto said exposed surface from one or more points vertically within said pre-formed side edges so that the exposed surface shadows said side edges from the spray;

at least partially curing said first coating;

applying a second coating of protective material primarily onto the high areas of said exposed surface; and curing the protective material.

2. The method according to claim 1 wherein said first coating of protective material is a coating of ultraviolet light curable protective material, and said first coating is at least partially cured by exposing it to ultraviolet radiation.

3. The method according to claim 1 wherein said second coating of protective material is a coating of ultraviolet light curable protective material and said protective material is cured by exposing it to ultraviolet radiation.

4. The method according to claim 1 wherein said plurality of base tiles is provided by arranging a continuous succession of said tiles on a transport means with front and back edges of adjacent tiles abutting and said first coating of protective material is sprayed onto said tile by transporting said plurality of tiles with abutting edges past at least one spray coating nozzle orbitally rotating vertically within the side edges of said tile.

5. The method according to claim 1 wherein said second coating is applied by roller coating.

6. The method according to claim 1 including the additional step of warming the exposed surface and first coating prior to the step of partial curing, in order to effect flowing and leveling of the first coating prior to curing.

7. The method according to claim 1 including the additional step of warming the exposed surface and second coating prior to the step of curing in order to effect flowing and leveling on the high areas of the second coating prior to curing.

8. The method according to claim 1 wherein said plurality of tiles are provided by successively feeding a plurality of single tiles in a row onto retardation means for slowing the forward motion of the tiles whereby a preceding tile is sufficiently slowed to cause the front edge of the next succeeding tile to abut against the back edge of said preceding tile.

9. The method according to claim 1 wherein said first coating is applied to substantially all of said exposed surface and said second coating, applied primarily to the high areas, has an average thickness which is greater than that of said first coating.

10. The method according to claim 1 wherein said protective coating material comprises a mixture of a monomeric carrier and a resin chosen from the group consisting of acryloester, acrylolactone, acrylourethane, acryloether or mixtures thereof.

11. A coated tile comprising a base layer having a decorative exposed surface having high areas and low areas defining said exposed surface, and disposed upon said exposed surface of said base layer a coating of protective material which has an average thickness on the high areas of the surface of said base layer which is greater than the average thickness on the low areas of said surface.

12. A coated tile according to claim 11 wherein said coating is a composite coating comprising a first coating of protective material covering at least the low areas of said exposed surface and a second coating covering substantially only the high areas.

13. A coated tile according to claim 12 wherein the second coating has an average thickness which is greater than the average thickness of said first coating.

14. A coated tile according to claim 12 wherein the first coating has an average thickness in the range between 0.3 and 0.6 mil and the second coating has an average thickness in the range between 1.5 and 3.5 mils.

15. A coated tile according to claim 11 wherein said coating of protective material is comprised of a resin selected from the group consisting of cured resins of acryloester, acryloether, acryloactone, and acrylourethane.

16. A coated tile according to claim 11 wherein said tile is comprised predominantly of vinyl asbestos and said coating of protective material is comprised predominantly of cured acrylourethane.

17. A coated tile according to claim 11 wherein said protective material is a coating of ultraviolet radiation cured resin.

18. Apparatus for applying a protective coating onto tiles having pre-formed front, back, and side edges and an exposed surface subject to wear, said apparatus comprising:

means for providing a continuous succession of base tiles with abutting front and back edges;

means for spraying a first coating of protective material onto said exposed surface from one or more points vertically within said side edges while said front and back edges are abutting one another;

means for at least partially curing said first coating;

roll coating means for applying a second coating of protective material onto said exposed surface; and means for curing the protective material.

19. Apparatus according to claim 18 wherein said means for spraying said first coating comprises a rotatably mounted spray head for orbitally rotating in an orbit disposed vertically within the side edges of said tile.

20. Apparatus according to claim 18 wherein said means for at least partially curing said first coating comprises a source of ultraviolet radiation.

21. Apparatus according to claim 18 wherein said means for curing said protective material comprises a source of ultraviolet radiation.

22. Apparatus according to claim 18 including means for heating said first coating in order to effect flowing and leveling thereof prior to curing.

23. Apparatus according to claim 18 including means for heating said second coating in order to effect flowing and leveling thereof prior to curing.

24. Apparatus according to claim 18 wherein said means for providing a continuous succession of base tiles comprises:

means for successively dealing base tiles one at a time from a stack onto a conveying means;

conveying means for receiving base tiles one at a time; and retardation means for slowing the forward motion of tiles whereby a preceding tile is sufficiently slowed to cause the front edge of the next succeeding tile to abut against the back edge of said preceding tile.

25. Apparatus for applying a protective coating onto tiles having pre-formed front, back, and side edges and an exposed surface subject to wear, said apparatus comprising:

means for providing a continuous succession of base tiles with abutting front and back edges;

means for spraying a first coating of ultraviolet radiation curable protective material onto said exposed surface from one or more points vertically within said pre-formed side edges while said front and back edges are abutting one another;

a source of ultraviolet radiation for at least partially curing said first coating;

roll coating apparatus for applying a second coating of ultraviolet radiation curable protective material primarily onto high areas of said exposed surface; and a source of ultraviolet radiation for curing said protective material.

26. Apparatus according to claim 25 wherein said means for spraying said first coating comprises a rotatably mounted spray head for orbitally rotating in an orbit disposed vertically within the side edges of said tile.

27. Apparatus according to claim 25 including means for warming said first coating prior to curing in order to effect flowing and leveling thereof prior to curing.

28. Apparatus according to claim 25 including means for warming said second coating prior to curing in order to effect flowing and leveling thereof prior to curing.

* * * * *